United States Patent [19]

McKay et al.

[11] Patent Number: 4,676,765

[45] Date of Patent: Jun. 30, 1987

[54] TOY BRIDGING VEHICLE

[75] Inventors: Robert S. McKay, 7420 Beckwith Rd., Morton Grove, Ill. 60053; William D. Nelson, Elgin, Ill.

[73] Assignee: Robert S. McKay, Wood Dale, Ill.

[21] Appl. No.: 867,477

[22] Filed: May 27, 1986

[51] Int. Cl.[4] ..... A63H 29/00

[52] U.S. Cl. ..... 446/457; 446/441; 446/462; 180/9.32

[58] Field of Search ..... 446/457, 462, 433, 441; 180/9.32; 280/5.2

[56] References Cited

U.S. PATENT DOCUMENTS

| | | | |
|---|---|---|---|
| 1,592,654 | 7/1926 | Bremer | 180/9.32 |
| 2,012,090 | 8/1935 | Straussler | 180/9.32 X |
| 3,535,821 | 10/1970 | Ieda | 446/441 |
| 4,222,449 | 9/1980 | Feliz | 280/5.2 X |

*Primary Examiner*—Kenneth Downey

*Attorney, Agent, or Firm*—Robert V. Jambor

[57] ABSTRACT

A self propelled toy vehicle provided with a self contained bridging assembly. A bridging assembly is provided which upon manual actuation is automatically positioned to be driven over by the toy vehicle as it climbs over an embankment or passes over a chasm. After the vehicle has passed over the bridging member, it is automatically returned to a rest position on top of the vehicle.

14 Claims, 9 Drawing Figures

Fig. 1.
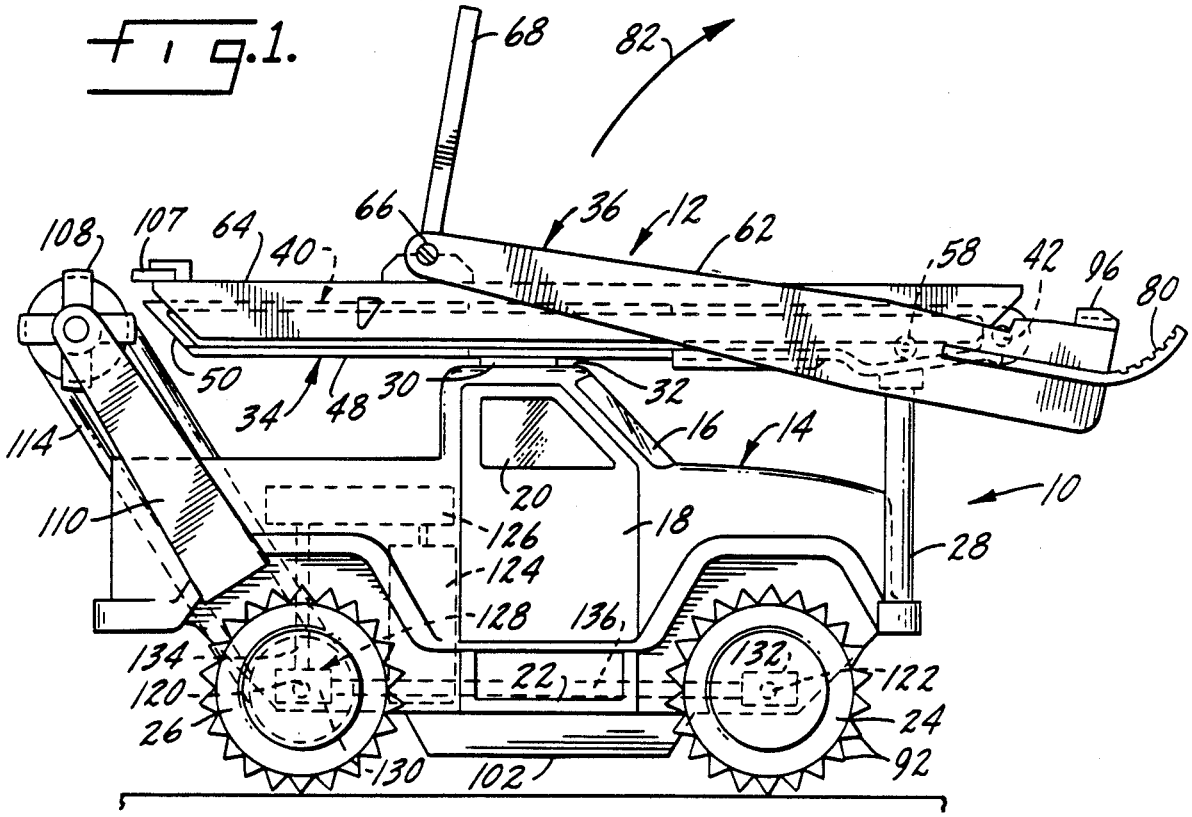
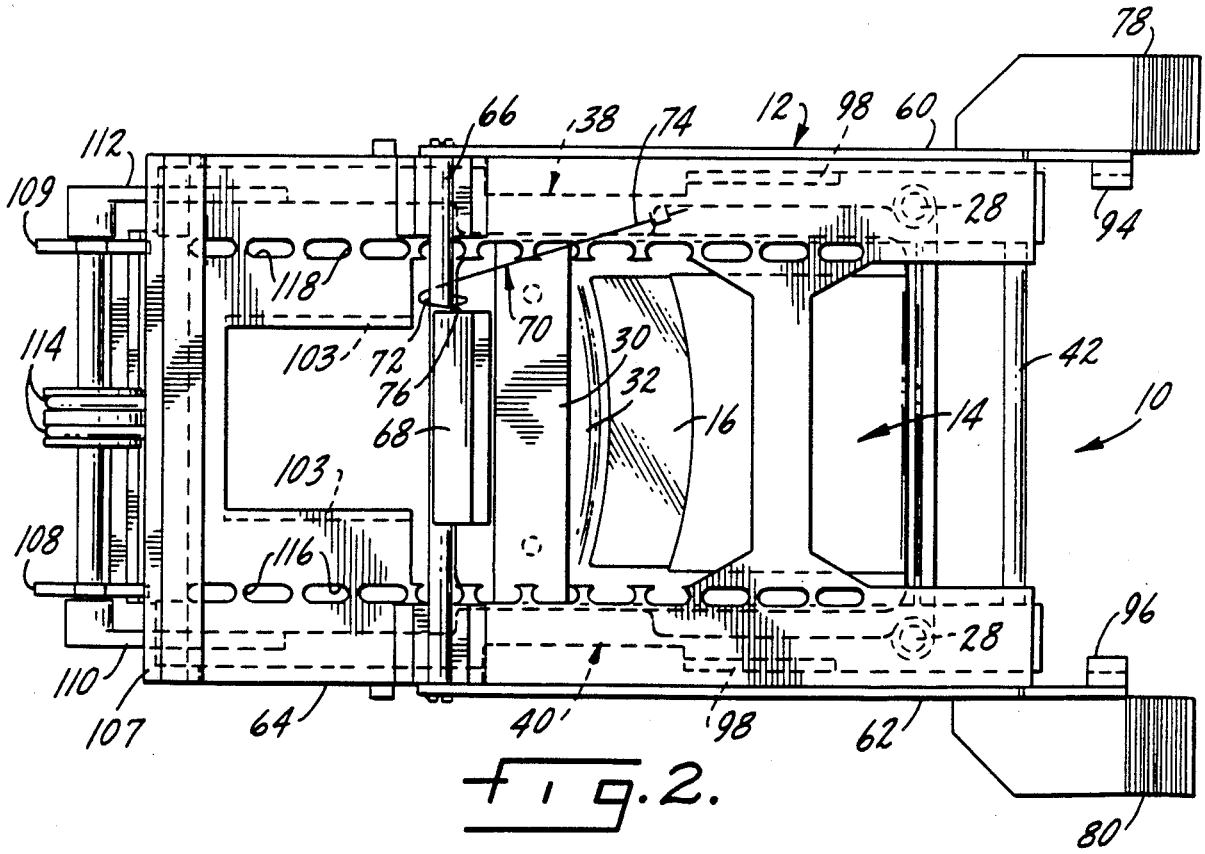
Fig. 2.

TOY BRIDGING VEHICLE

BACKGROUND OF THE INVENTION

This invention relates to a toy vehicle which is provided with a self contained bridging assembly which permits the vehicle to climb over vertical embankments and to pass over chasms in the surface on which it is traveling.

SUMMARY OF THE INVENTION

The present invention encompasses a self propelled toy vehicle which is provided with a self contained bridging assembly. Upon manual actuation, a bridging member is automatically positioned so that the driven front wheels of the vehicle will engage a bridge member to cause the vehicle to be driven over the bridge member which may rest against the edge of a vertical embankment or span a chasm. As the driven rear wheels of the vehicle pass off of the bridge member, the bridging assembly is automatically lifted over the rear of the vehicle and stored on top of the vehicle in its rest or stored position.

DESCRIPTION OF THE DRAWINGS

FIG. 1 is a side elevation view a preferred embodiment of the self propelled toy vehicle of this invention, with the self contained bridging assembly in the rest position;

FIG. 2 is a top elevation view of the bridging assembly of the self propelled toy vehicle shown in FIG. 1;

DESCRIPTION OF THE PREFERRED EMBODIMENT

Figure 3:
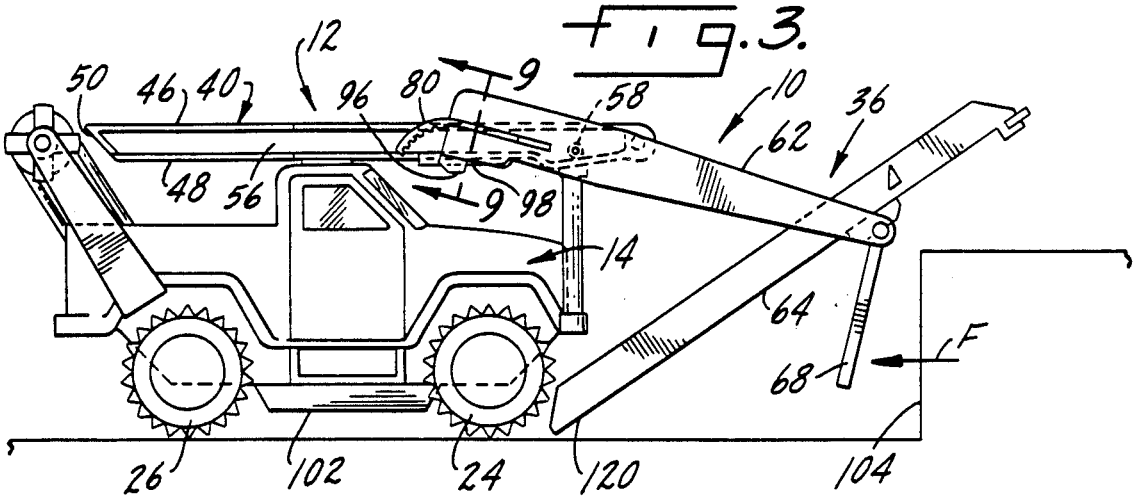
FIG. 3 is a side elevation view of the self propelled toy vehicle shown in FIG. 1, with the bridging assembly shown in the ready position.

Referring to FIG. 1, a bridging vehicle 10, constructed in accordance with this invention, is shown with a bridging means 12 in the at rest or stored position. The bridging vehicle 10 includes a body which is shown in the form of a pick-up truck. The body 14, which in the preferred embodiment is formed of plastic, is decorated so as to provide the appearance of a windshield 16, door 18, with window 20, and a running board 22. The bridging vehicle 10 is supported on a pair of axles 120 and 122, each of which is provided with a pair of wheels. A drive means, such as an electrical motor 124 and gear train 126 is provided within the body 14 to drive the wheels, including front wheels 24 and rear wheels 26, one of each of which is shown. In the preferred embodiment, the drive motor 124 drives the front and rear axles through a drive train 128, consisting of gear boxes 130 and 132 and shafts 134 and 136.

The bridging means 12 is supported above the vehicle body 14 by a pair of posts 28, located at the front corners of the vehicle 10, and by a plate 30 resting on and secured to the top 32 of the cab of the truck body. The bridging means 12 includes a stationary support means 34 and a movable bridge assembly 36. The stationary support means 34 includes a pair of spaced apart elongated parallel guide members 38 and 40, connected to each other by a rod 42 at the front of the vehicle, and the plate 30 at the center of the vehicle.

Figure 6:
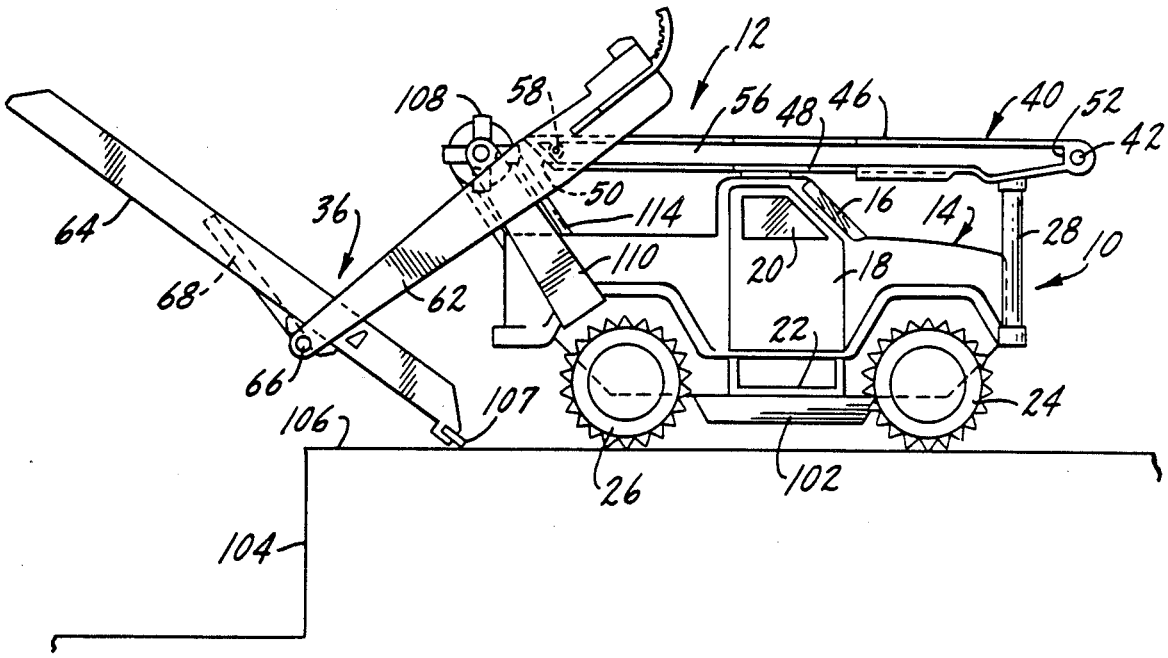
FIG. 6 is a side elevation view of the self propelled toy vehicle shown in FIG. 1, wherein the bridging assembly is about to be returned to the rest position.
Figure 7:
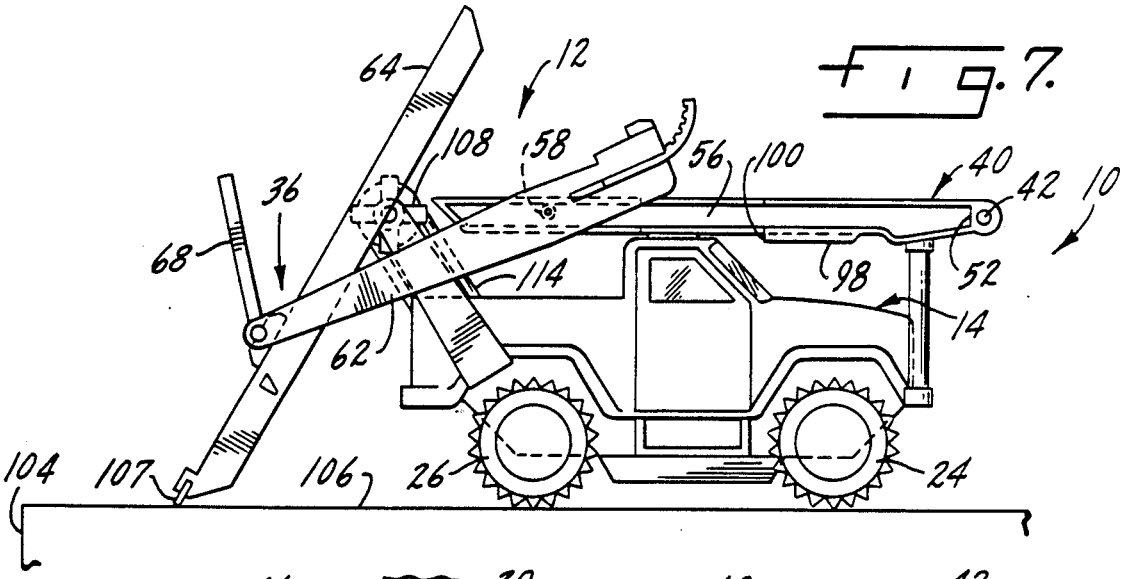
FIG. 7 is a side elevation view of the self propelled toy vehicle shown in FIG. 1, wherein the bridging assembly is shown in a second position prior to being returned to the rest position.
Figure 8:
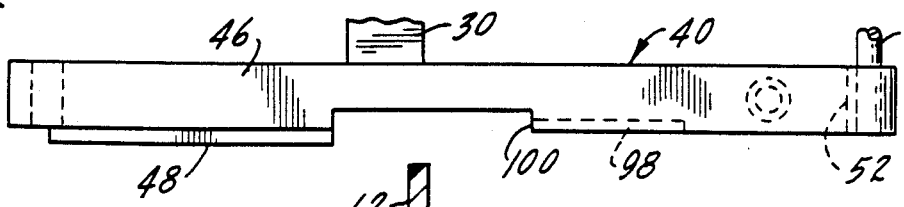
FIG. 8 is a top elevation view of the guide member portion of the bridging assembly shown in FIG. 2.

As is best seen in FIGS. 2 and 8, both of the guide members 38 and 40 have a generally hollow rectangular cross-section. Guide member 40 includes a top rail 46 and a bottom rail 48, which are connected at the rear by an upwardly and rearwardly sloping wall 50, and at the front by a vertical wall 52. The top rail 46, bottom rail 48, sloping wall 50, and vertical wall 52 form an elongated slot 56 in which is confined an end of a rod 58, as shown in FIG. 6. A similar elongated slot is formed in guide member 38 to support the other end of rod 58. The movable bridge assembly 36 is supported from the stationary support means 34 by engagement of the rod 58 with either the top rail 46, the bottom rail 48, or the sloping wall 50.

The movable bridge assembly 36 includes a pair of support arms 60 and 62, and a bridge platform 64. The bridge platform 64 is pivotally secured to the support arms 60 and 62 by a rod 66. Fixed to and extending radially from the rod 66 is an actuator arm 68. Both the support arms 60 and 62, and the actuator arm 68 are secured to the rod 66, such that their relative angular position is maintained, and such that they rotate with rod 66. As is shown in FIG. 2, a spring 70 has a coiled portion 72 which is placed over the rod 66, a first arm 74, which engages the bridge platform 64, and a second arm 76 which engages the actuator arm 68, so as to provide a biasing force between support arms 60 and 62, and the bridge platform 64, to maintain them in the position, relative to each other, shown in FIG. 1. This position will be referred to as the rest position. In the rest position, as shown in FIGS. 1 and 2, the lower surface of the bridge platform 64 rests upon the top surface of the guide members 38 and 40.

Figure 4:
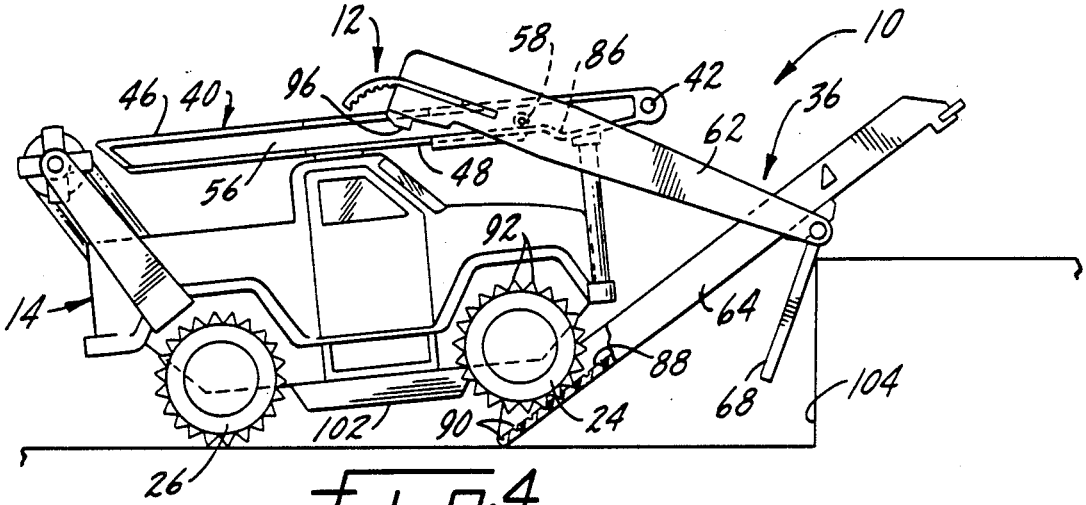
FIG. 4 is a side elevation view of the self propelled toy vehicle shown in FIG. 1, with the bridging assembly in a first operative position.
Figure 5:
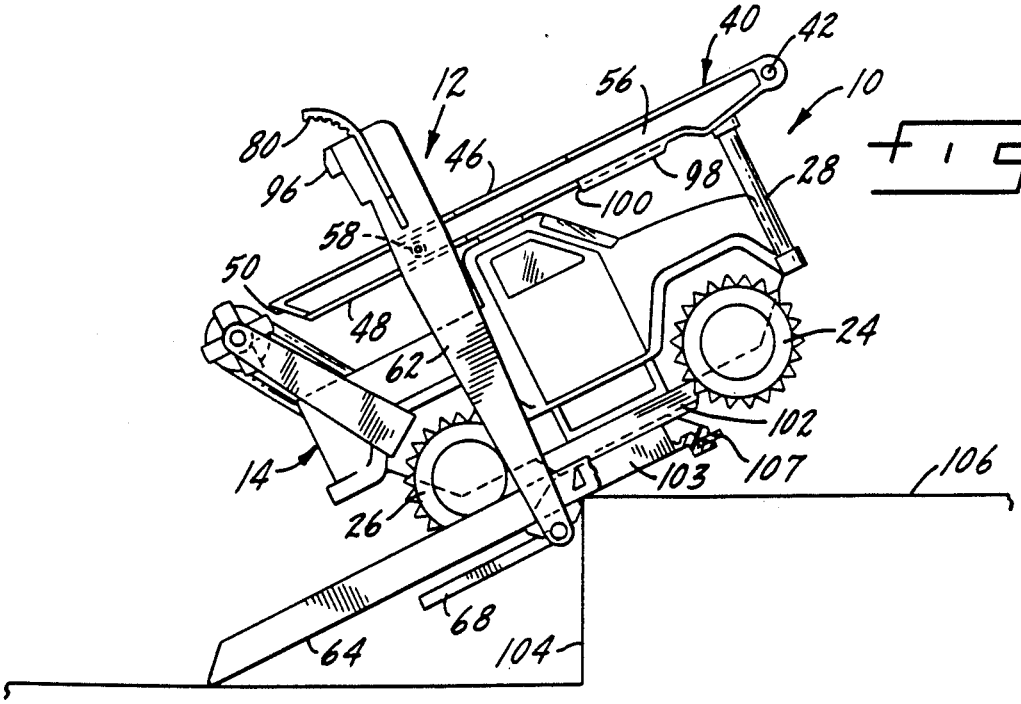
FIG. 5 is a side elevation view of the self propelled toy vehicle shown in FIG. 1, with the bridging mechanism is a second operative position.

Formed on the front edge of the support arms 60 and 62 are a pair of manual actuators 78 and 80. A manual actuating means is provided to move the movable bridge assembly 36 from the rest position, shown in FIG. 1, to a ready position, as shown in FIG. 3, and thereafter to the operating positions, as shown in FIGS. 4 and 5. A manually applied downward or clockwise force with respect to rod 58, is applied to one or both of the manual actuators 78 and 80. This force will cause the movable bridge assembly to rotate in the clockwise direction, as indicated by the arrow 82 in FIG. 1, to the ready position shown in FIG. 3.

Figure 9:
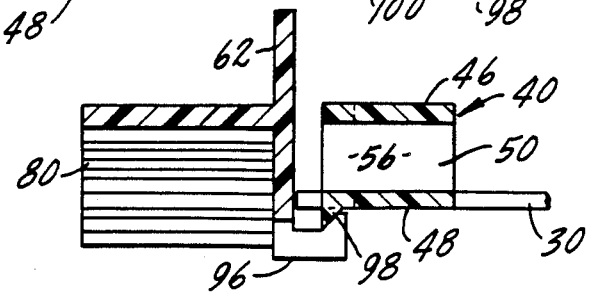
FIG. 9 is a cross-sectional view taken along the line 9—9 in FIG. 3, showing only two members of the bridging assembly.

The movable bridge assembly 36 is prevented from rotating further in the clockwise direction, as represented by the arrow 82 in FIG. 1, from the position shown in FIG. 3, by the engagement of a pair of latch members 94 and 96, with projections extending from the guide members 38 and 40. One of these projections 98 is shown in FIGS. 8 and 9. The vehicle 10 may continue to move in a forward direction with the movable bridge assembly 36 in the ready position, as shown, in FIG. 3, until a rearward force, as represented by the letter F, is applied to the actuator arm 68. The rearward movement of the movable bridge assembly 36, by the application of force F, will cause the latches 94 and 96 to be disengaged from the bottom rail 48. For instance, referring to FIGS. 8 and 9, when the latch 96 reaches an edge 100, it will no longer be retained by the bottom rail 48 and will be free to move upwardly, such that the support arms 60 and 62 can rotate further in the direction of arrow 82 in FIG. 1. The application of the force F will cause the rod 58 to move from the position shown in FIGS. 1 and 2, wherein it is located directly over the post 28, upwardly out of a pocket 86 formed in the bottom rail 48 to the position shown in FIG. 4, where it rests on a flat portion of the bottom rail 48. As the rod 5 moves to the position shown in FIG. 4, the front wheels 24 will engage a track 88 provided on the top surface of the bridge platform 64. Projections 92, which provide a first engagement means, are formed on the wheels 24 and 26. The track 88 is provided with indentations 90, part of a second engagement means, which are spaced to coincide with the spacing of projections 92, so as to provide positive engagement therewith. Rotation of the wheels 24 will cause the vehicle to move onto the bridge platform 64, as shown in FIG. 4.

Further rotation of the front wheels 24 will cause the vehicle to move forward on the track 88, as viewed in FIG. 4. To maintain the truck in a level position with respect to the track 88, a downwardly projecting skid 102 is provided on the bottom of the truck body 14 to engage upstanding projections 103 on the inner edge of the platform 64, as shown in FIGS. 2 and 5. It will be observed in FIG. 5, that the front wheels 24 have passed off of the leading edge of the track 88, but prior to their doing so, the rear wheels 26 have engaged the track 88, so as to continue to move the truck body 14 forward with respect to the track 88. When the truck body 14 reaches the position, with respect to the track 88, shown in FIG. 5, the rear wheels 26 and skid 102 are held in engagement with the track 88 by engagement of the rod 58 with the bottom rail 48 of the guide members 38 and 40. If the force F applied to the actuating arm 68 is caused by engagement with a wall 104, as shown in FIG. 4, the lower surface of the bridge platform 64 will rest on top of the wall 104, such that as the truck body 14 continues to move forward with respect to the track 88, the center of gravity of the bridging vehicle 10 will move to the right of the wall 104, such that the bridging vehicle 10 will rotate clockwise, with the lower surface of the bridge platform 64 resting on an upper level 106.

Continued rotation of the drive wheels 24 and 26 will cause the body 10, including the rear drive wheel 26, to move off of the forward end of the bridge platform 64, and will at the same time cause the rod 58 to move toward the rear of the guide members 38 and 40. As shown in FIG. 6, a frictional member 107 is provided on the leading edge of the bridge platform 64 to engage the surface over which the bridging vehicle 10 is moving to cause the platform 64 to rotate clockwise with respect to the support arms 60 and 62. This clockwise rotation of the bridge platform 64 will cause the upper surface of the track 88 to engage star wheels 108 and 109 which are supported at the rear of the vehicle body 14 by a pair of supporting arms 110 and 112. The star wheels 108 and 109 are driven in a clockwise direction, as viewed in FIGS. 1, and 3 through 7, by a pair of belts 114. Belt 114 are driven by the same motor that provides the rotational force to drive front wheels 24 and rear wheels 26. The star wheels 108 and 109 are provided with projections, which form a third engagement means to engage the slots 116 and 118 part of the second engagement means, formed in the bridge platform 64. Rotation of the star wheels 108 and 109 will cause the platform 64 to be lifted up over the vehicle, with the support arms 60 and 62, and rod 58 being moved forward with respect to guide members 38 and 40. As the end of the platform 64 provided with frictional member 107 passes over the star wheels 108 and 109, movable bridge assembly 36 will drop to the rest position, as shown in FIG. 1.

While the operation of the bridging vehicle has been described with respect to its climbing over an obstacle, it is also possible for the bridge to be used to permit the bridging vehicle 10 to pass over a chasm in the surface over which it is traveling. In this mode of operation, a force is applied to one or both the manual actuator 78 and 80 to flip the movable bridge assembly 36 to its ready position, as shown in FIG. 3. A force F is applied to the actuator arm 68 just prior to the trailing edge 120 of the bridge platform 64 reaching the edge of the chasm. As the bridging vehicle continues to move forward, the bridge platform 64 will drop down over the chasm, with the end of the bridging platform 64 provided with the frictional material 107 engaging the surface on the far side of the chasm. During this type of operation, the bridging vehicle 14 will pass over the chasm while being supported by the bridge platform 64. After having passed over the chasm, the movable bridging assembly 36 will be picked up and returned to its rest position, as shown in FIG. 1, in the same manner as previously described.

It should be apparent to those skilled in the art, that while what has been described is considered at present to be a preferred embodiment of the self propelled toy vehicle with self contained bridging assembly, in accordance with the patent statutes, changes may be made in the vehicle and self contained bridging assembly without actually departing from the true spirit and scope of this invention. For instance, the support arms for supporting the bridge platform from the stationary support means may be articulated. Further, drive means may be provided for moving the movable bridge assembly to the operating position.

We claim:

1. A toy vehicle comprising:

a body provided with a drive means;

at least two axles, each having secured thereto at least one wheel, said wheels being driven by said drive means;

a bridging means supported by said body including:

a stationary support means positioned above said body;

a movable bridge assembly connected to said stationary support means, said movable bridge assembly including a platform, movable between a rest position and an operating position;

an actuating means;

a retracting means driven by said drive means;

actuation of said actuating means causing said platform to be moved from the rest position to the operating position, to be engaged by and driven over by said wheels, said retracting means moving said platform from the operating position to the rest position after said body has passed over said platform.

2. The toy vehicle as defined in claim 1, wherein said stationary support means positioned above said body includes a pair of spaced apart elongated parallel guide members.

3. The toy vehicle as defined in claim 1, wherein said movable bridge assembly includes means pivotally attached to both said stationary support means and said platform to movably secure said platform to said stationary support means.

4. The toy vehicle as defined in claim 2, wherein said movable bridge assembly includes means pivotally attached to both said stationary support means and said platform, the pivotal attachment to said stationary support means being movable along the length of said elongated parallel guide members.

5. The toy vehicle as defined in claim 4, wherein the pivotal attachment to said stationary support means, moves from the front towards the rear of said elongated parallel guide members as said platform is driven over by said wheels.

6. The toy vehicle as defined in claim 1, wherein said wheels are provided with a first engagement means and said platform is provided with a second engagement means, said first and second engagement means engaging each other as said wheels are driven over said platform.

7. The toy vehicle as defined in claim 6, wherein said retracting means is provided with a third engagement means, said second and third engagement means engaging each other as said retracting means moves said platform from the operating position to the rest position.

8. The toy vehicle as defined in claim 7, wherein said retracting means includes at least one circular member driven by said drive means, and said third engagement means is provided on the circumference of said at least one circular member.

9. The toy vehicle as defined in claim 6, wherein said second engagement means includes a pair of tracks and said first engagement means is provided on the circumference of said wheels.

10. The toy vehicle as defined in claim 1, wherein the actuating means is a lever positioned in front of said body, and said actuating means is actuated by pushing said lever toward said body.

11. The toy vehicle as defined in claim 1, wherein said drive means is an electric motor.

12. The toy vehicle as defined in claim 1, having two axles, each of which axles is provided with two wheels, so as to provide a four-wheel drive vehicle.

13. The toy vehicle as defined in claim 1, wherein said body is formed as a pick-up truck having a cab located near the center of the body.

14. The toy vehicle as defined in claim 1, wherein said platform in moving from said rest position to said operating position is inverted.

* * * * *